US008225985B2

(12) United States Patent
Oliveira

(10) Patent No.: US 8,225,985 B2
(45) Date of Patent: Jul. 24, 2012

(54) PIZZA CARTON WITH CURVED TOP

(75) Inventor: Steven Manuel Oliveira, Nashua, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 83 days.

(21) Appl. No.: 12/794,078

(22) Filed: Jun. 4, 2010

(65) Prior Publication Data

US 2010/0237137 A1 Sep. 23, 2010

Related U.S. Application Data

(63) Continuation of application No. 11/678,883, filed on Feb. 26, 2007, now Pat. No. 7,762,450.

(60) Provisional application No. 60/777,322, filed on Feb. 28, 2006.

(51) Int. Cl.
*B65D 5/12* (2006.01)

(52) U.S. Cl. ..... 229/107; 229/116.1; 229/906

(58) Field of Classification Search ..... 229/107, 229/116.1, 902, 906, 132, 182.1; 206/303, 206/304, 448
See application file for complete search history.

(56) References Cited

U.S. PATENT DOCUMENTS

| | | | | |
|---|---|---|---|---|
| 926,758 | A | | 7/1909 | Miller |
| 2,382,368 | A | | 8/1945 | Mitchell, Jr. |
| 2,465,121 | A | * | 3/1949 | Ringler ..... 206/303 |
| 3,638,851 | A | | 2/1972 | Offer et al. |
| 3,807,624 | A | * | 4/1974 | Funkhouser ..... 206/427 |
| 3,904,036 | A | | 9/1975 | Forrer |
| 3,912,074 | A | * | 10/1975 | Vargo ..... 206/303 |
| 4,173,823 | A | | 11/1979 | Anderson et al. |
| 4,360,107 | A | | 11/1982 | Roccaforte |
| 4,476,989 | A | | 10/1984 | Larsen |
| 4,567,341 | A | | 1/1986 | Brown |
| 4,765,534 | A | | 8/1988 | Zion et al. |
| D311,339 | S | | 10/1990 | Weed |
| D318,235 | S | | 7/1991 | Weed |
| 5,071,062 | A | | 12/1991 | Bradley et al. |
| 5,118,032 | A | | 6/1992 | Geho |
| 5,263,634 | A | | 11/1993 | Korine |
| 5,535,940 | A | | 7/1996 | Olds |
| 5,560,539 | A | | 10/1996 | Baxter |
| 5,806,755 | A | | 9/1998 | Correll |
| 5,833,130 | A | | 11/1998 | Correll |
| 6,109,512 | A | | 8/2000 | Morrison |
| 6,155,480 | A | * | 12/2000 | Botsford et al. ..... 229/116.1 |
| 6,206,277 | B1 | | 3/2001 | Correll |
| 6,290,122 | B1 | | 9/2001 | Correll |

(Continued)

FOREIGN PATENT DOCUMENTS

DE 295 04 256 U1 5/1995

(Continued)

*Primary Examiner* — Gary Elkins
(74) *Attorney, Agent, or Firm* — Womble Carlyle Sandridge & Rice, LLP

(57) ABSTRACT

A carton for holding a food product. The carton has a plurality of panels that extend at least partially around an interior of the carton. The plurality of panels comprises a front panel, a back panel, a first side panel, and a second side panel. The front and back panels each have a curved edge at an end of the carton.

24 Claims, 3 Drawing Sheets

U.S. PATENT DOCUMENTS

| | | | | |
|---|---|---|---|---|
| 6,375,066 | B1 | 4/2002 | Ritter | |
| 6,571,539 | B2 | 6/2003 | Gendre et al. | |
| 7,000,803 | B2 | 2/2006 | Miller | |
| 7,331,505 | B2 * | 2/2008 | Holley, Jr. | 229/136 |
| 7,762,450 | B2 | 7/2010 | Oliveira | |
| 7,766,219 | B2 * | 8/2010 | Gomes et al. | 220/906 |

FOREIGN PATENT DOCUMENTS

| | | | |
|---|---|---|---|
| EP | 1 260 448 | A1 | 11/2002 |
| EP | 1 661 813 | A1 | 5/2006 |
| WO | WO 98/39220 | | 9/1998 |

* cited by examiner

PIZZA CARTON WITH CURVED TOP

CROSS-REFERENCE TO RELATED APPLICATION

This application is a continuation of U.S. patent application Ser. No. 11/678,883, filed Feb. 26, 2007, which application claims the benefit of U.S. Provisional Application No. 60/777,322, filed Feb. 28, 2006.

INCORPORATION BY REFERENCE

The entire contents of U.S. patent application Ser. No. 11/678,883, filed Feb. 26, 2007, and U.S. Patent Application No. 60/777,322, filed Feb. 28, 2006, are hereby incorporated by reference as if presented herein in their entirety.

BACKGROUND OF THE INVENTION

The present invention relates generally to a carton for holding a food product. More specifically, the present invention relates to a carton for holding a frozen pizza.

Paperboard cartons for holding food products such as frozen pizzas are known. The cartons typically are square-shaped and are closed at the top, bottom, sides, front, and back to form a six-sided, fully enclosed carton that contains the pizza and provides surface areas for printing graphics such as advertisements or nutritional information. It is desired to minimize the material required for existing cartons while still providing a full display panel for graphics. Also, it is desired to provide a carton that has a unique appearance and shape.

SUMMARY OF THE INVENTION

In general, one aspect of the invention is directed to a carton for holding a food product. The carton comprises a plurality of panels that extend at least partially around an interior of the carton. The plurality of panels comprises a front panel, a back panel, a first side panel, and a second side panel. The front and back panels each have a curved edge at an end of the carton.

In another aspect, the invention is generally directed to a blank for forming a carton for holding a food product. The blank comprises a plurality of panels comprising a front panel, a back panel, a first side panel, and a second side panel. The front and back panels each have a curved edge at a lateral end of the blank.

In another aspect, the invention is generally directed to a method of forming a carton. The method comprises providing a blank having a front panel, a back panel, a first side panel, a second side panel, a first side end flap foldably connected to the first side panel, and a second side end flap foldably connected to the second side panel. The front panel and the back panel have curved edges. The method comprises forming a sleeve by folding the blank to position the front panel in generally opposed planar relationship with the back panel so that the curved edges comprise an open end of the sleeve. The method further comprises at least partially closing the open end by bending the side end flaps relative to the side panels to conform to the curved edges of the front and back panels.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

Corresponding parts are designated by corresponding reference numbers throughout the drawings.

DETAILED DESCRIPTION OF THE ILLUSTRATED EMBODIMENT

The carton of the present invention is particularly useful in containing a food product such as a frozen pizza and providing surfaces on which graphics including advertising or other information may be displayed to convey information to a consumer. It is understood that food products other than pizza may be contained in the carton without departing from the scope of this invention. Further, food products contained in this carton may be generally round, square, rectangular, or any other shape without departing from the scope of this invention.

Figure 1:
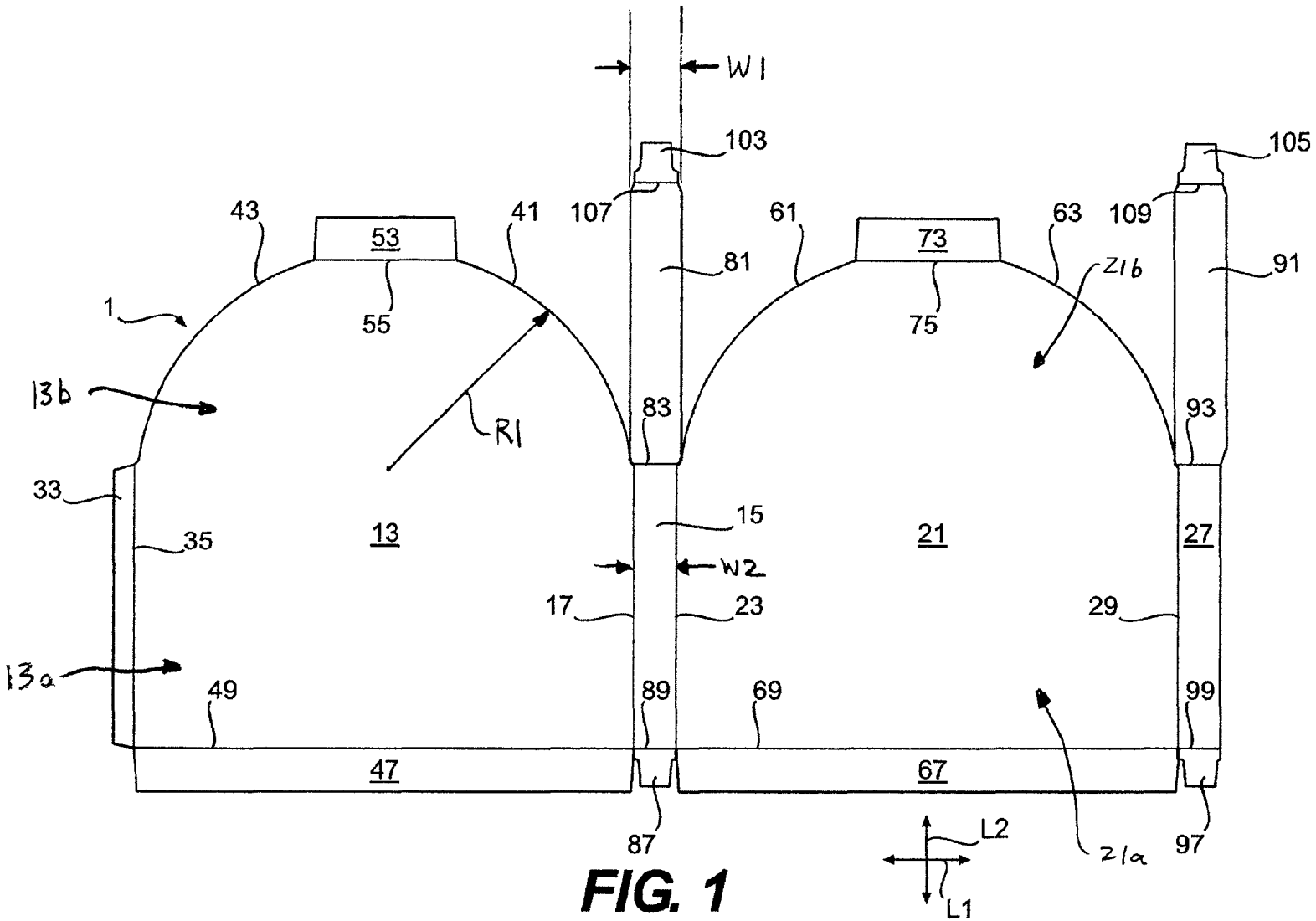
FIG. 1 is a plan view of a blank used to form a carton according to a first embodiment.
Figure 2:
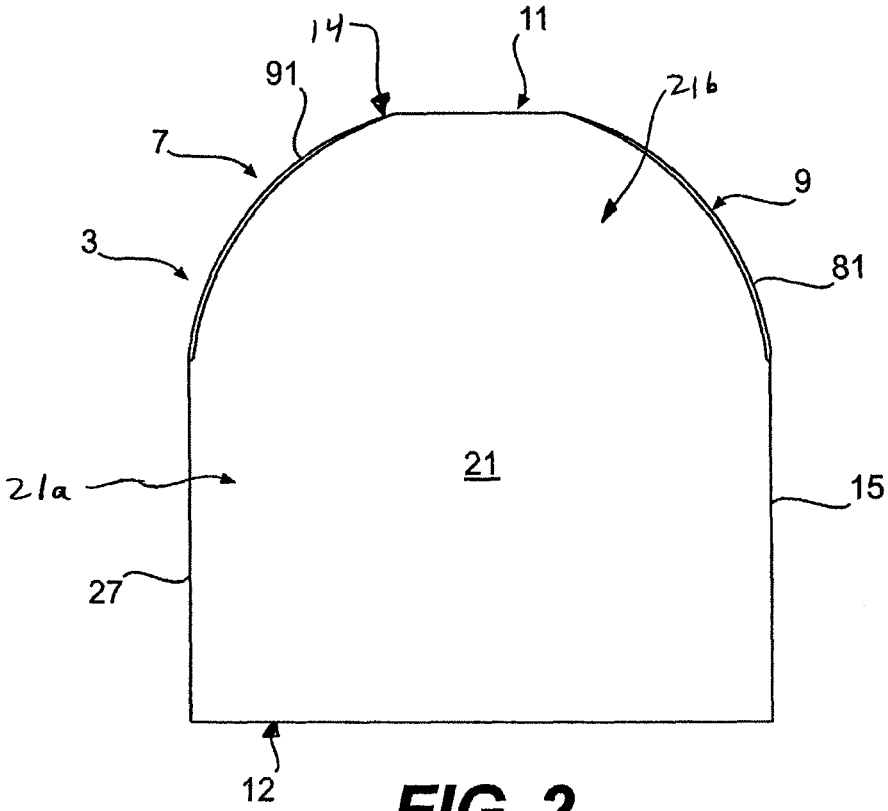
FIG. 2 is a front elevation of the carton.
Figure 3:
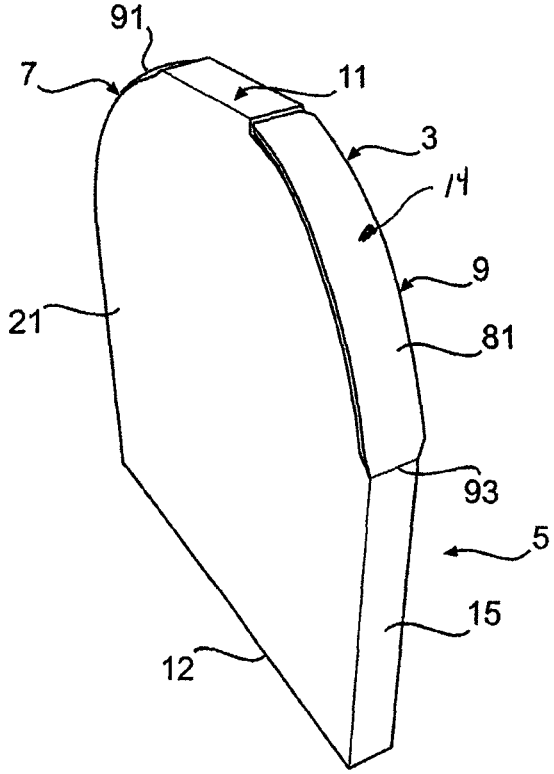
FIG. 3 is a side perspective of the carton.

FIG. 1 is a plan view of a first, front side of a blank, generally indicated at 1, used to form a carton, generally indicated at 3 (FIGS. 2 and 3), according to one embodiment of the invention. As shown in FIG. 2, the carton 3 has a generally flat bottom wall 12, two lower side walls 8, 10 generally perpendicular to the bottom wall, two curved upper side walls 7, 9 extending up from the lower side walls, and a generally flat top wall 11. The flat bottom wall 12 that allows the carton 3 to be positioned in the upright position supported on a shelf or other display rack (not shown). The curved upper side walls 7, 9 generally conform to the shape of a pizza P or other food product that is contained in the carton 3 for displaying the product to a consumer. The side walls 7, 9 and flat top wall form a closed top 14 of the carton 3.

In accordance with the illustrated embodiment of the invention, the blank 1 has a longitudinal axis L1 and a lateral axis L2. The blank 1 comprises a back panel 13 foldably connected to a first side panel 15 at a first transverse fold line 17. A front panel 21 is foldably connected to the first side panel 15 at a second transverse fold line 23 and is foldably connected to a second side panel 27 at a third transverse fold line 29. An adhesive flap 33 is foldably connected to the back panel 13 at a fourth transverse fold line 35.

The back panel 13 has two curved edges 41, 43 each extending upwardly from a respective transverse fold line 17, 35 at a lateral end of the blank. The back panel 13 is foldably connected to a first bottom end flap 47 at a longitudinal fold line 49. A first top end flap 53 is foldably connected to the back panel 13 at a longitudinal fold line 55 and is positioned between the two curved edges 41, 43 of the back panel 13.

In the illustrated embodiment, the front panel 21 has two curved edges 61, 63 each extending upwardly from a respective transverse fold line 23, 29 at a lateral end of the blank 1. The front panel 21 is foldably connected to a second bottom end flap 67 at a longitudinal fold line 69. A second top end flap 73 is foldably connected to the front panel 21 at a longitudinal fold line 75 and is positioned between the two curved edges 61, 63 of the front panel 21.

The first side panel 15 is foldably connected to a first side end flap 81 at longitudinal fold line 83. The first side panel 15 is foldably connected to a second side end flap 87 at a longitudinal fold line 89. The second side panel 27 is foldably connected to a first side end flap 91 at longitudinal fold line 93. The second side panel 27 is foldably connected to a second side end flap 97 at a longitudinal fold line 99. The side end flaps 81, 91 have a width W1 in the longitudinal direction L1 of the blank 8 that is greater than the width W2 of the corresponding side panel 15, 27. In accordance with one embodiment of the invention, each of the side end flaps 81, 91 has a respective adhesive tab 103, 105 foldably connected at a respective transverse fold line 107, 109 forming an upper free end of each respective side end flap.

In the illustrated embodiment, the longitudinal fold lines 49, 69, 89, 99 may be a single continuous fold line that extends lengthwise of the blank. The end flaps 47, 67, 87, 97 extend along a marginal arch of the blank and are for closing the bottom 12 of the carton 3. The side end flaps 81, 91 and top end flaps 53, 73 are for closing the top of the carton 5.

In one embodiment, the front panel 21 and back panel 13 each have a lower generally rectangular portion 13*a*, 21*a* and an upper, generally semicircular portion 13*b*, 21*b*. In the illustrated embodiment, the curved edges 41, 43, 61, 63 are continuous radial edges each having a radius R1 of equal length. In the illustrated embodiment, the front panel 21 and the back panel 13 each have an identical shape, but the front and back panel may have different shapes without departing from the invention.

In one embodiment, the side end flaps 81, 91 have a width W1 that is in the range of approximately 0 to 50% greater than the width W2 of the side panels 15, 27. In one embodiment, the width W1 is approximately 1¼ inches (32 mm) and the width W2 is approximately 1 inch (25 mm). In one embodiment, the radius R1 of the curved edges 41, 43, 61, 63 is at least approximately 2 inches (51 mm), and more preferably approximately 5¾ inches (146 mm). All dimensional information presented herein is intended to be illustrative of various embodiments of the invention and is not intended to limit the scope of the invention.

One example of a suitable method for erecting the blank 1 and loading the carton 3 is described in the following. The blank 1 of the illustrated embodiment may be assembled into the carton 3 by following a generally open ended sleeve by placing the front panel 21 in generally opposed planar relationship with the back panel 13 so that the front panel is spaced apart from the back panel by the first and second side panels 15, 27. The first side panel 15 is folded ninety degrees relative to the back panel 13 along fold line 17 so that the first side panel is perpendicular to the back panel and extends upward therefrom. The front panel 21 is then folded 90 degrees relative to the first side panel 15 at fold line 23 so that the front panel is in generally opposed planar relationship with the back panel 13. Next, the second side panel 27 is folded downward relative to the front panel 21 at fold line 29 and the adhesive flap 33 is folded upward relative to the back panel 13 at fold line 35 to be generally parallel and adjacent with the second side panel. The side end flaps 87, 97 are folded at respective fold lines 89, 99 and the bottom end flaps 47, 67 are folded at respective fold lines 49, 69 and overlapped with each other to close one end of the sleeve 125 (FIG. 4) and to form the closed bottom wall 12 of the carton 3. The bottom end flaps 47, 67 may be joined by adhesive to close the bottom wall 12 of the carton 3. The second side panel 27 and adhesive panel 33 may be joined by adhesive to secure the carton 3 in the partially assembled position shown in FIG. 4. In this position the carton 3 comprises a sleeve 125 with a closed bottom wall 12 and open top. A food product such as a frozen pizza P (FIG. 2) is placed in the sleeve 125 by sliding the pizza through the open top end of the sleeve. As will be discussed below, the side flaps 81, 91 and top end flaps 53, 73 are assembled to form a closed carton 3 having a curved upper side walls 7, 9.

Figure 4:
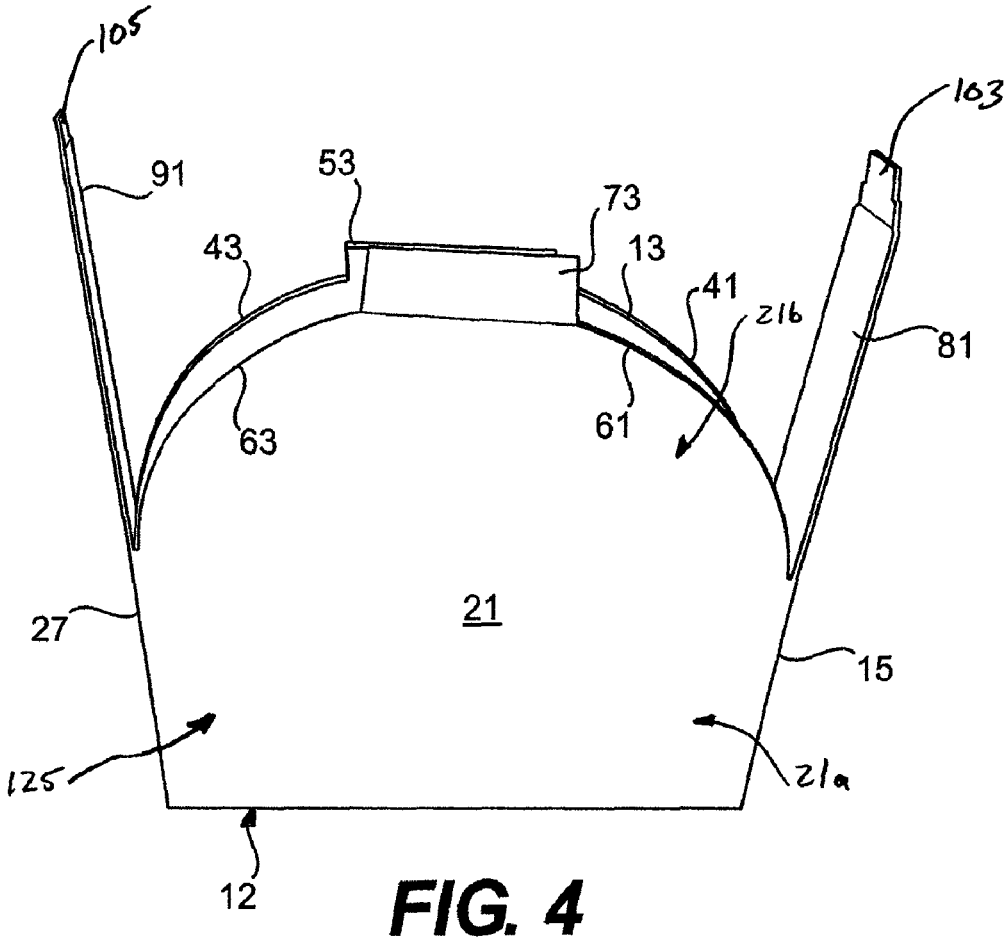
FIG. 4 is a front perspective of the carton in a partially assembled configuration.

From the partially assembled position of FIG. 4, the top end flaps 53, 73 are folded at respective fold lines 55, 75 so that the top end flaps overlap. In accordance with the illustrated embodiment, each of the fold lines 55, 75 extends straight between respective ends of the curved edges 41, 43, 61, 63. In accordance with one embodiment of the invention, top end flap 73 overlaps the top end flap 53 and the side end flaps 81, 91 are folded at respective fold lines 83, 93 and bent so to a generally curved shape so that the adhesive tabs 103, 105 are received underneath the top end flap 53. The top end flaps 53, 73 and adhesive tabs 103, 105 may be joined by adhesive to close the top wall 11 of the carton 3. In the assembled position, the side end flap 81 is curved (e.g., it was bent) to conform to the spaced apart curved edges 41, 61 of the back and front panels 13, 21, and the side end flap 91 is curved (e.g., it was bent) to conform to the spaced apart curved edges 43, 63 of the back and front panels. In the illustrated embodiment, the width of the side end flaps 81, 91 is greater than the space between the curved edges 41, 61 and 43, 63 so that the side end flaps contact the curved edges of the back and front panels 13, 21. It is understood that the side end flaps 81, 91 could be otherwise sized and shaped without departing from the scope of this invention. For example, they could include a series of fold lines or other features that seek to aid in their being bent into the shown arcuate shape. Also, other closing configurations and steps for forming the carton 3 could be used without departing from the invention.

In one embodiment, the food product held in the carton 3 is a round frozen pizza P having a diameter of approximately 11.5 inches (292 mm). It is understood, that the food product could have shapes other than circular (e.g., square, rectangular, etc.) without departing from the scope of this invention.

It is understood that various sizes of pizzas or other food products may be housed in the carton 3. Also, graphics including advertising or other information may be printed on the outer surfaces of the carton including the outer surface of the back panel 13 and the front panel 21, and the side panels 15, 27 to convey information to the consumer. The curved side end flaps 81, 91 form the curved upper side walls 7, 9 of the carton 3 so that the side walls generally conform to the shape of the pizza P held in the carton. The overlapping bottom end flaps 47, 67 form the flat bottom wall 12 that allows the carton to be positioned in an upright position shown in FIG. 2 on a shelf or display rack. It is understood that an opening feature such as a removable panel defined by one or more tear lines may be added to the carton 3 without departing from the scope of this invention.

In the exemplary embodiment discussed above, the blank is formed from clay coated paperboard, typically having a caliper of at least about 18, so that it is heavier and more rigid than ordinary paper. The blank, and thus the carton, can also be constructed of other materials, such as cardboard, or any other material having properties suitable for enabling the carton to function at least generally as described above. The first and second sides of the blank can be coated with, for example, a clay coating. The clay coating may then be printed over with product, advertising, and other information or images. The blank may then be coated with a varnish to protect any information printed on the blank. The blank may also be coated with, for example, a moisture barrier layer, on either or both sides of the blank. The blank can also be laminated to or coated with one or more sheet-like materials at selected panels or panel sections.

In accordance with the exemplary embodiments, a fold line can be any substantially linear, although not necessarily straight, faun of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. The term "line" as used herein includes not only straight lines, but also other types of lines such as curved, curvilinear or angularly displaced lines.

The above embodiments are described as having one or more panels adhered together by glue. The term "glue" is intended to encompass all manner of adhesives commonly used to secure carton panels in place.

The term "line" as used herein includes not only straight lines, but also other types of lines such as curved, curvilinear or angularly displaced lines.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carton for holding a food product, the carton comprising:

a plurality of panels that extend at least partially around an interior of the carton, wherein the plurality of panels comprises a front panel, a back panel, a first side panel, and a second side panel, the first side panel being foldably connected to the front panel and the back panel, the second side panel being foldably connected to at least one of the front panel and the back panel;

with the front and back panels each having a curved edge at an end of the carton; and end flaps respectively foldably attached to panels of the plurality of panels, wherein the end flaps are overlapped with respect to one another and thereby at least partially close the end of the carton, the end flaps comprise at least one side end flap foldably attached to one of the first and second side panels and curved for at least partially closing the end of the carton, and at least one top end flap foldably attached to one of the front panel and the back panel, the at least one top end flap cooperates with the at least one side end flap to at least partially close the end, wherein the at least one side end flap is bent to conform to at least one of the curved edge of the front panel and the curved edge of the back panel to at least partially close the end.

2. The carton of claim 1 wherein the at least one side end flap comprises a first side end flap foldably attached to the first side panel and a second side end flap foldably attached to the second side panel, and wherein the first side end flap forms a first curved top wall and the second side end flap forms a second curved top wall.

3. The carton of claim 2 wherein each of the curved edge of the front panel is spaced apart from the curved edge of the back panel at the end of the carton.

4. The carton of claim 3 wherein the first and second side end flaps are at least partially overlapped with and adhered to the at least one top end flap.

5. The carton of claim 1 wherein the top end flap is a first top end flap, the end flaps comprise a second top end flap, and the first and second top end flaps are respectively foldably connected to the front panel and the back panel, and wherein the first and second top end flaps form a flat top wall of the carton.

6. The carton of claim 2 wherein:

the end is a first end;

the end flaps are first end flaps that are overlapped with respect to one another to close the first end; and the carton further comprises at least two second end flaps respectively foldably attached to respective panels of the plurality of panels, wherein the second end flaps are overlapped with respect to one another to form a closed second end of the carton.

7. The carton of claim 6 wherein the first end is a top end comprising a flap top wall formed by the top end flap and the two curved side walls extending downwardly from the flat top wall, and the second end is a bottom end comprising a flat bottom wall.

8. The carton of claim 1 wherein at least one of the front panel and the back panel has a first surface area, at least one of the first side panel and the second side panel has a second surface area, the first surface area being greater than the second surface area so that the at least one of the front panel and the back panel is sized to support a greater amount of printed graphics on the exterior of the carton than the at least one of the first side panel and the second side panel.

9. The carton of claim 1 wherein the at least one side end flap is in contact with the curved edge of the front panel and the curved edge of the back panel to at least partially close the end.

10. The carton of claim 1 wherein the at least one side end flap has a width and the curved edge of the front panel is spaced apart from the curved edge of the back panel by a distance, the width being greater than or approximately equal to the distance.

11. A blank for forming a carton for holding a food product, the blank comprising:

a plurality of panels comprising a front panel, a back panel, a first side panel, and a second side panel, the first side panel being foldably connected to the front panel and the back panel, the second side panel being foldably connected to at least one of the front panel and the back panel;

wherein each of the front and back panels has a respective curved edge at a lateral end of the blank, end flaps respectively foldably attached to panels of the plurality of panels, wherein the end flaps are for being overlapped with respect to one another and thereby at least partially close the end of the carton formed from the blank, and the end flaps comprise at least one side end flap foldably attached to one of the first and second side panels for being curved when at least partially closing the end of the carton formed from the blank, and at least one top end flap foldably attached to one of the front panel and the back panel, the at least one top end flap being for cooperating with the at least one side end flap to at least partially close the end when the carton is formed from the blank, wherein the at least one side end flap is for being bent to conform to at least one of the curved edge of the front panel and the curved edge of the back panel to at least partially close the end when the carton is formed from the blank.

12. The blank of claim 11 wherein the front and back panels each have two curved edges, the curved edges are continuous radial edges having a radius of equal length, and wherein the front panel and the back panel each comprises an at least partially circular upper portion and a rectangular lower portion.

13. The blank of claim 11 wherein the at least one side end flap comprises a first side end flap foldably attached to the first side panel and a second side end flap foldably attached to the second side panel.

14. The blank of claim 13 wherein the end flaps comprise a first top end flap foldably connected to the back panel and a second top end flap foldably connected to the front panel, the curved edge of the front panel is a first front curved edge, the front panel further comprises a second front curved edge at the lateral end of the blank, the curved edge of the back panel is a first back curved edge, the back panel further comprises a second back curved edge at the lateral end of the blank, the first top end flap extends from the first back curved edge to the second back curved edge, and the second top end flap extends from the first front curved edge to the second front curved edge.

15. The blank of claim 11 wherein at least one of the front panel and the back panel has a first surface area, at least one of the first side panel and the second side panel has a second surface area, the first surface area being greater than the second surface area so that the at least one of the front panel and the back panel is sized to support a greater amount of printed graphics on the exterior of the carton than the at least one of the first side panel and the second side panel.

16. The blank of claim 11 wherein the at least one side end flap is for being in contact with the curved edge of the front panel and the curved edge of the back panel to at least partially close the end when the carton is formed from the blank.

17. The blank of claim 11 wherein the at least one side end flap has a first width and the one of the first side panel and second side panel has a second width, the first width being greater than or approximately equal to the second width.

18. A method of forming a carton, the method comprising:

providing a blank having a front panel, a back panel, a first side panel, a second side panel, the first side panel being foldably connected to the front panel and the back panel, the second side panel being foldably connected to at least one of the front panel and the back panel, a first side end flap foldably connected to the first side panel, a second side end flap foldably connected to the second side panel, and at least one top end flap foldably connected to one of the front panel and the back panel with the front panel and the back panel having respective curved edges;

forming a sleeve by folding the blank to position the front panel in generally opposed planar relationship with the back panel so that the curved edge of the front panel and the curved edge of the back panel comprise an open end of the sleeve;

at least partially closing the open end by bending the first side end flap and the second side end flap relative to the first side panel and the second side panel to respectively conform at least one of the first side end flap and the second side end flap to the curved edge of the front panel and the curved edge of the back panel and at least partially overlapping at least one of the first side end flap and the second side end flap with the at least one top end flap.

19. The method of claim 18 wherein the end is a top end and the at least one top end flap comprises a first top end flap foldably connected to the back panel and a second top end flap foldably connected to the front panel, and the closing of the open end comprises overlapping and adhering the top end flaps and the side end flaps.

20. The method of claim 19 wherein the top end is a first end, the sleeve comprises an open bottom end, the top end flaps and side end flaps are first end flaps, the blank further comprises second end flaps including side end flaps and bottom end flaps, and the method further comprises overlapping the second end flaps to close the bottom end.

21. The method of claim 20 further comprising inserting a food product into the sleeve prior to closing the top end.

22. The method of claim 20 further comprising inserting a food product into the sleeve after closing the bottom end.

23. The method of claim 18 wherein the bending the first side end flap and the second side end flap comprises positioning at least one of the first side end flap and the second side end flap to contact the curved edge of the front panel and the curved edge of the back panel to at least partially close the open end.

24. The method of claim 18 wherein each of the first side end flap and the second side end flap has a respective width and the curved edge of the front panel is spaced apart from the curved edge of the back panel by a distance, the width of the first side end flap and the width of the second side end flap being greater than or approximately equal to the distance.

* * * * *